US006212908B1

(12) United States Patent
Melas

(10) Patent No.: US 6,212,908 B1
(45) Date of Patent: Apr. 10, 2001

(54) JEWELRY RING WITH SECURITY ASPECT

(76) Inventor: Yianni Melas, Riedweg 46, Wattens (AT), A-6112

( * ) Notice: Subject to any disclaimer, the term of this patent is extended or adjusted under 35 U.S.C. 154(b) by 0 days.

(21) Appl. No.: 09/317,280

(22) Filed: May 24, 1999

(51) Int. Cl.[7] ..... A44C 19/00

(52) U.S. Cl. ..... 63/15; 63/26; 63/28; D11/26; D11/34

(58) Field of Search ..... 63/15, 26, 28; D11/26, 34

(56) References Cited

U.S. PATENT DOCUMENTS

| | | | | |
|---|---|---|---|---|
| D. 35,795 | * | 3/1902 | Schimmel | 63/3 |
| D. 63,994 | * | 2/1924 | Bross | 63/15 X |
| D. 64,849 | * | 6/1924 | Granat | 63/15 X |
| D. 68,970 | * | 12/1925 | Kinsley | 63/15 X |
| D. 113,962 | * | 3/1939 | Brophy | D11/26 |
| D. 118,031 | * | 12/1939 | Widess | D11/29 |
| D. 119,052 | * | 2/1940 | Sheman | 63/15 X |
| D. 135,032 | * | 2/1943 | Carson | D11/26 X |
| D. 140,125 | * | 1/1945 | Touraine | D11/34 |
| D. 193,404 | * | 8/1962 | Telford | D11/26 |
| D. 248,379 | * | 7/1978 | Durante | D11/3 |
| D. 372,682 | * | 8/1996 | Roemer | D11/34 |
| D. 372,881 | * | 8/1996 | Morelli | D11/34 |
| 1,285,473 | * | 11/1918 | Tripp | 63/15 X |
| 1,565,651 | * | 12/1925 | Klass et al. | 63/15.7 |
| 1,681,687 | * | 8/1928 | Schraysshuen | D1/26 |
| 1,913,463 | * | 6/1933 | Toelcke | 63/15 |
| 1,972,128 | * | 9/1934 | Bobbroff | 63/15 |
| 1,983,348 | * | 12/1934 | Dieges | 63/15 X |
| 2,241,165 | * | 5/1941 | Shelton | 63/15 |
| 2,332,344 | * | 10/1943 | Roskin | 63/15 |
| 2,653,402 | * | 9/1953 | Bonagura | 40/662 |
| 4,878,364 | * | 11/1989 | Freilich | 63/28 |
| 4,936,699 | * | 6/1990 | Yoshida | 401/48 |

FOREIGN PATENT DOCUMENTS

| | | | | |
|---|---|---|---|---|
| 2226131 | * | 11/1974 | (FR) | 63/15 |

OTHER PUBLICATIONS

Printout from GPI Web Client for JP 410075809A, Mar. 1998.*

* cited by examiner

*Primary Examiner*—Terry Lee Melius
*Assistant Examiner*—Andrea Chop
(74) *Attorney, Agent, or Firm*—Levisohn, Lerner, Berger & Langsam

(57) ABSTRACT

A jewelry ring having a main ring with two half-ring segments, where each of the ring segments has its own design. The design of the first ring segment is more prominent than the design of the second segment and is typically displayed to an outside viewer. However, when, for security or any other reason, the wearer rotates the ring, the second half with the less prominent design is displayed, concealing the more prominent design of the first half without alerting a robber that a more prominent design is hidden.

16 Claims, 3 Drawing Sheets

JEWELRY RING WITH SECURITY ASPECT

FIELD OF THE INVENTION

The present invention relates to an article of jewelry. More specifically, the present invention relates to a jewelry ring which has a more prominent design which typically will be shown to a viewer and a less prominent design which ordinarily will be located at the hidden or palm part of the ring but can be selectively turned around, i.e., rotated on the wearer's finger to be seen by a viewer. In this position, the more prominent design is rotated so that it is hidden from view. In this way, a fanciful jewelry ring is provided with a security feature.

BACKGROUND OF THE INVENTION

Rings are popular items of jewelry which have been worn by women and men for centuries. Generally rings are made out of a solid metal material. The most common form of a ring constitutes a simple metallic band, often of gold or silver alloy, fitted for the wearer's finger. More elaborate rings have been made to contain precious or semi-precious gems, engravings and so forth.

Rings containing elaborate designs and precious or semi-precious gems of a relatively large carat weight are very desirable, yet expensive and therefore have been objects of numerous robberies. Robbers, who see large ornate rings, actually approach the wearer and threaten violence unless the wearer removes the ring and gives it to the robber. Consequently, many jewelry and ring wearers when they are in the public streets or in a less secure environment, tend to turn their expensive rings 180° around on their finger to hide the expensive design and/or gem from view of a would-be-robber. However, an observant viewer would notice that the opposite or now-exposed side of the ring looks like the rear portion of a more ornate ring. Stated another way, the forward projected, yet rotated back of an ornate ring or a ring with a large gem looks exactly like the back of an ornate ring or one with a large gem. No one, certainly not a sophisticated robber, is fooled. The front of an ornate or gem-bearing ring is wide to support the gem. The sides of an ornate ring are usually tapered toward the back to provide for more comfortable wear. When the ring is turned, the tapering makes it obvious that the ring was turned around on the finger. As a result, instead of providing more security to the wearer, the above manipulations attract unwanted attention by alerting the potential robber that there may be a large gem on the hidden side of the ring that is worth hiding.

Rings can be divided into four segments, i) the prominent design segment; ii) two sides which usually taper down from the design segment and iii) the rear or palm-facing segment. Some rings, of course, have fanciful designs which extend from the design segment to the sides, even all the way around to the palm facing segment. However, extending gems and/or ornate design around the entire ring can be expensive. Presently available jewelry ring constructions with large gems or prominent designs on the design segment generally do not have many gems or design on the palm facing segment because such a design typically would not be observed by an outside viewer, thus "wasting" the expense. However, there are numbers of people, usually called "expressive" talkers, who enhance their speech with hand gestures. "Expressive" talkers frequently show the inside or palms of their hands while talking, and many of them would prefer to wear rings that could show some design or artistic appeal during conversations, instead of the mere plain, palm facing segment of the ring and, yet, in addition to the traditional outwardly facing design segment.

Additionally, the ability of the wearer to be in contact with the gemstone itself is important for people who believe in the healing power of gems, know as "crystal healing." Traditional designs do not allow for such contact unless the ring is rotated until the prominent design segment is located inside the wearer's palm. The rear or palm-facing segment, which typically lacks any ornamentation, is then displayed to a viewer.

Accordingly, there is a need in the art for ring constructions that would allow a wearer to conceal an expensive design of the prominent design segment of the ring (to avoid robberies, for example) while not raising suspicions of potential robbers. There is also an interest in the art for a construction which can allow wearers to display a less prominent design, on the palm facing side, while showing the inside of their hands, while also maintaining the large gem or design on the outside facing segment.

SUMMARY OF THE INVENTION

It is an object of the present invention to provide a ring construction which will allow the wearer to selectively, securely conceal the prominent design portion on the ring's front or outer surface, and yet a viewer will still see a design or gem, as if the ring were an ornate (yet less ornate) ring, only with a less prominent design when the ring is turned for security.

It is another object of the present invention to provide a ring construction which can be easily manipulated by the wearer to present different "looks."

It is a further object of the present invention to provide a ring with a prominent front-facing design section and a smaller palm-facing design section.

Other objects, advantages and features of this invention will be more apparent hereinafter.

The objects of the present invention are accomplished by providing a ring construction having a ring with two main segments connected by side segments. Each of the main ring segments has its own design. The design of the first ring segment is considered more "important," substantial or prominent than the design of the second segment. The first ring segment is typically displayed for viewing. The two segments are located about 180° from one another. However, when, for security or any other purpose, the wearer selectively rotates the ring, the second segment with the less prominent design or gem is displayed, concealing the more prominent design of the first segment within the wearer's palm, without alerting a potential robber that a more prominent design is hidden.

BRIEF DESCRIPTION OF THE DRAWINGS

A full understanding of the invention can be gained from the following description of the preferred embodiment when read in conjunction with the accompanying drawings in which.

DETAILED DESCRIPTION OF THE DRAWINGS AND THE PREFERRED EMBODIMENT

Figure 1:
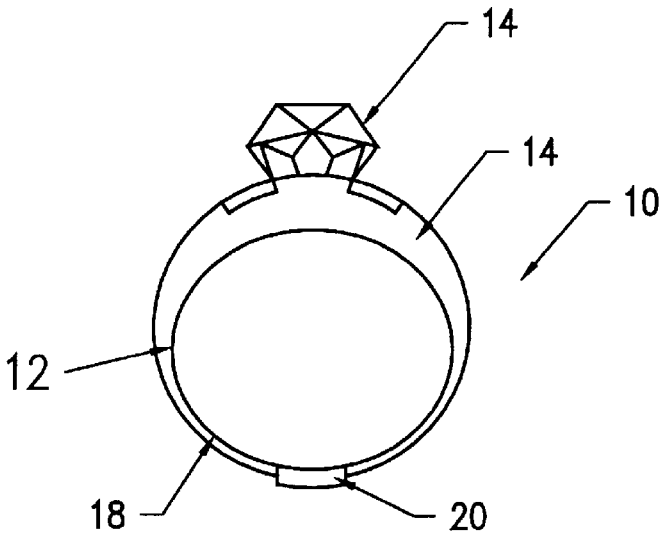
FIG. 1 is a side view of the ring in accordance with the first embodiment of the present invention, where the more prominent design segment holds, in this example, a prong set diamond solitaire and the less prominent design segment contains a bezel set solitaire or a gem of smaller carat weight and size.

As best seen in the drawings, in the preferred embodiment of the present invention, a jewelry ring 10 is provided which can be manipulated to present two different appearances to an outside viewer. Jewelry ring 10 basically consists of a main ring 12 which presents a first ring segment 14 and a second ring segment 18. In the preferred embodiment the first ring segment 14 is a solid gold ring segment extending about 180° with a diamond solitaire 16 of a relatively large carat weight. The second ring segment 18 may also comprise a solid gold ring portion extending about 180°. In the preferred embodiment, the second ring segment also holds a diamond solitaire 20 yet, here, it is of a relatively small carat weight. See FIG. 1. The ring 12 is suitably sized to fit comfortably on the wearer's finger yet large enough to be rotated about its axis without discomfort to the wearer.

Figure 4:
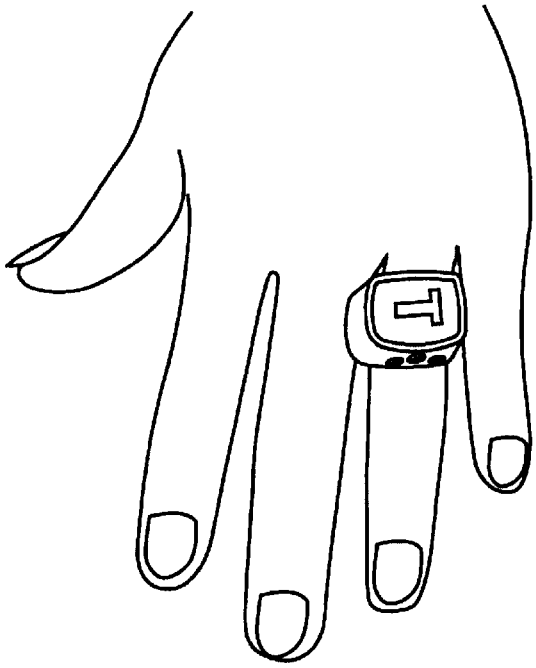
FIG. 4 is a top view of a wearer's hand showing the first segment of the ring as shown in FIG. 3.
Figure 5:
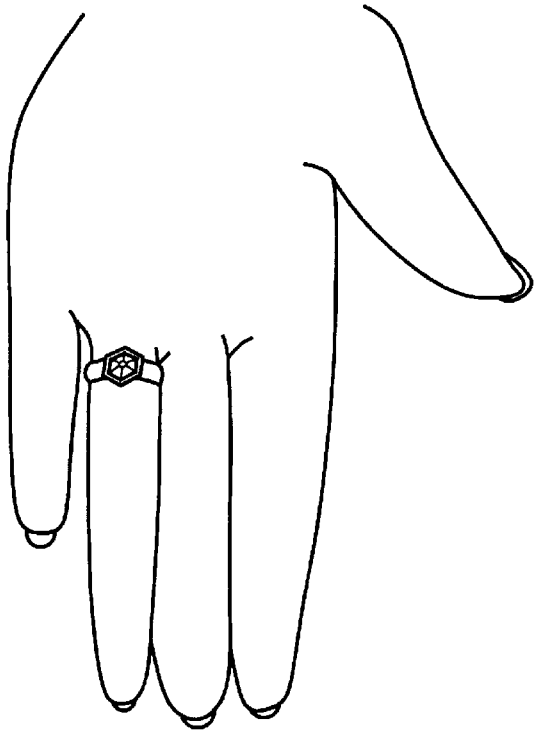
FIG. 5 is a palm view of the wearer's hand of FIG. 4 (without rotation of the ring about the finger), wearing the ring shown in FIG. 3 where the first design segment is faced outwardly and is not visible.
Figure 7:
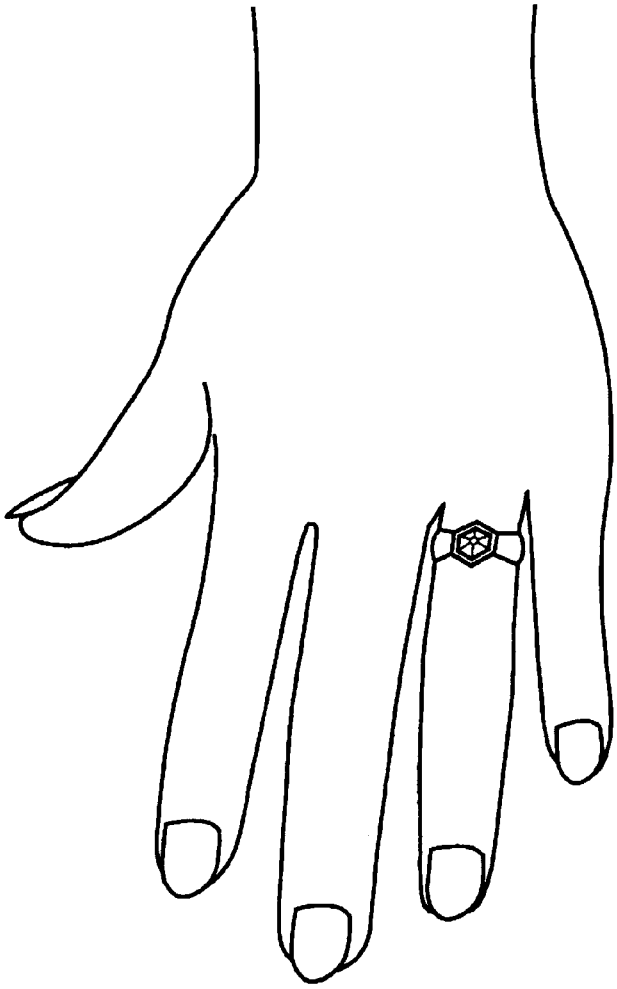
FIG. 7 is a top view of the wearer's hand when the ring of FIG. 3 has been rotated so that the less prominent design or second design segment is displayed outward to a viewer and the more prominent design segment is hidden or palm-facing.

During a normal wear, the first segment of the ring with the more prominent design (for example, the larger diamond) is located on the outer surface of the wearer's hand and can be observed by an outside viewer (see FIG. 4). As shown in FIG. 5, the less prominent design, diamond or solitaire is then located on the inside of the hand, palm-facing and is hidden from an outsider's view. Selectively, the ring may be rotated 180° about the wearer's finger so that the first segment 14 of the main ring is palm-facing or hidden and the second segment 18 is outwardly shown, displaying to the public the less prominent solitaire 20 (see FIG. 7).

The ability to display the less prominent design when the ring is rotated will allow the wearer to hide the more prominent design without alerting a potential robber about the existence or value of the hidden design. Availability of the smaller solitaire 20 on the second segment of the main ring provides an additional benefit to "expressive" talkers (who often show the inside or palm side of their hands while talking), allowing them to display the less prominent design of their rings during a conversation with the more prominent design shown outwardly.

The wearer of the jewelry ring with the security feature is also capable of being in direct contact with the gemstone itself when the prominent design segment is rotated so as to be inside the palm. This still allows the less prominent design segment to be outwardly displayed. The palm contact with the prominent design segment is important for people who believe in the healing powers of gems. When the wearer closes the hand, the inside of the fingers come in contact with the gem. In times of stress or sickness, the wearer can close the hand and get a "dose of healing" by touching the stone. Psychologically, such contact brings a boost of security and well-being for those who believe in "crystal healing."

Figure 2:
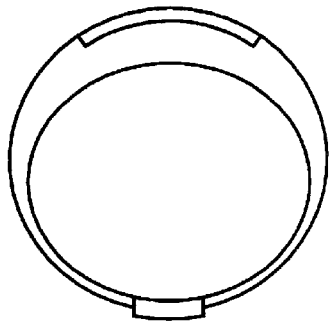
FIG. 2 is a side view of a different embodiment of the ring in accordance with the present invention, where the more prominent design segment is a row or rows of laser-cut channel-set diamonds and the less prominent design segment is a downsized yet visually related version of the more prominent design.
Figure 6:
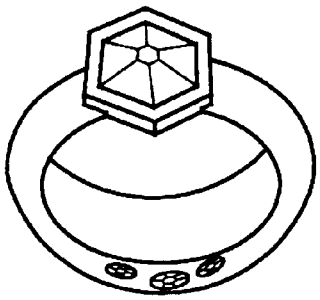
FIG. 6 is a bottom perspective view of the second design portion of the ring shown in FIGS. 3–5.

In the preferred embodiment shown in FIG. 2, the second segment of the main ring presents the same, although scaled down, design as the design of the first segment. However, the first and second segments may present different appearances to the viewer, as shown in FIGS. 4 and 6, for example. These segments of the main ring can differ in their sculpture, in the types, positions or styles of the gems placed thereon, in their engravings and so forth. Any conventionally known gem-cut can be used with the present invention, such as round, marquis, pear, emerald, princess, etc. To reduce value of the less prominent design, while preserving its aesthetic appeal, synthetic stones may be used to create such design instead of natural precious or semi-precious gems.

The more prominent design, may be one or several precious or semi-precious gems which are prong set, channel set or bezel set in the first segment of the ring. The traditional six-prong setting, conventionally known as "Tiffany setting," is preferred when the more prominent design is a diamond solitaire. Such design may also include several baguette-cut stones on both sides of the solitaire. The less prominent solitaire design is preferably channel or bezel set so as not to scratch any surface which may be touched by the wearer's palm when the ring is worn with the larger gem to the outside.

Figure 3:
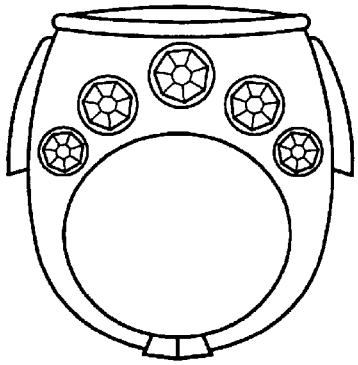
FIG. 3 is a side view of another embodiment of the ring in accordance with the present invention, where designs of the first design segment and the second design segment of the ring are visually different, yet, clearly, the first segment is a more prominent display segment than the second display segment.

As best seen in FIG. 1, the first jewelry design comprises a prong set diamond or gem. The prong set raises the top surface or table of the gem substantially above the outside circumferential wall of the ring. The second ring designs, shown in FIGS. 1, 2, 3 and 5, show the diamond or gem substantially flush or only slightly raised above the outside circumferential wall of the ring. FIGS. 3 and 5 show the second ring design, a gemstone, in a bezel mounting. Thus, it should be appreciated that the second jewelry designs shown in FIGS. 1, 2, 3 and 5 are substantially flush with or only slightly raised above the outside circumferential wall of the ring in contrast to the first jewelry ring design which is prong set or substantially above the outside circumferential wall of the ring, as shown in FIG. 1.

Having described this invention with regard to specific embodiments, it is to be understood that the description is not meant as a limitation since further variations or modifications may be apparent or may suggest themselves to those skilled in the art. It is intended that the present application cover such variations and modifications as fall within the scope of the appended claims.

I claim as follows:

1. A jewelry ring comprising:

a first half-ring segment and a second half-ring segment, said first and second half-ring segments defining a continuous outside circumferential ring wall;

a first jewelry design comprising a prong-set stone located on said first half-ring segment, said first jewelry design having said stone extending substantially above said outside circumferential ring wall;

a second jewelry design located on said second half-ring segment and about 180° around said jewelry ring from said first jewelry design, said second jewelry design being basically flush or extending only slightly above said outside circumferential ring wall;

wherein said second jewelry design is substantially less visually and physically prominent than said first jewelry design such that said jewelry ring can be rotated on the finger to selectively outwardly display only one of either said first jewelry design or said second jewelry design.

2. A jewelry ring according to claim 1, wherein said first half-ring segment subtends about 180° of said jewelry ring.

3. A jewelry ring according to claim 1, wherein said second half-ring segment subtends about 180° of said jewelry ring.

4. A jewelry ring according to claim 1, wherein said second design is a downsized, yet visually congruent version of said first design.

5. A jewelry ring according to claim 1, wherein said first design is a diamond solitaire.

6. A jewelry ring according to claim 5, wherein said diamond solitaire is prong set.

7. A jewelry ring according to claim 5, wherein said diamond solitaire is bezel set.

8. A jewelry ring according to claim 1, wherein said second design is a diamond solitaire.

9. A jewelry ring according to claim 8, wherein said diamond solitaire is bezel set.

10. A jewelry ring according to claim 1, wherein said second design is bezel set.

11. A jewelry ring according to claim 1, wherein said second design is a synthetic gem.

12. A jewelry ring according to claim 1, wherein said first design is a precious gem.

13. A jewelry ring according to claim 1, wherein said second design is a precious gem.

14. A jewelry ring according to claim 1, wherein said first design is a semi-precious gem.

15. A jewelry ring according to claim 1, wherein said second design is a semi-precious gem.

16. A jewelry ring according to claim 1 wherein said second jewelry design is comprised of at least one faceted stone in a setting which has its table basically coplanar with said circumferential ring wall.

* * * * *